US005459562A

United States Patent [19]

Mitsuya et al.

[11] Patent Number: 5,459,562

[45] Date of Patent: Oct. 17, 1995

[54] RECORDING APPARATUS FOR PRINTING BOTH FACES OF A RECORDING MEDIUM USING AN ELECTROPHOTOGRAPHYPROCESS

[75] Inventors: Teruaki Mitsuya; Yasuyuki Tsuji, both of Katsuta; Yoshihiro Gunji; Hiroshi Hakuta, both of Nakaminato; Yasuo Takuma, Hitachi, all of Japan

[73] Assignees: Hitachi, Ltd.; Hitachi Koki Co., Ltd, both of Tokyo, Japan

[21] Appl. No.: 249,790

[22] Filed: May 26, 1994

Related U.S. Application Data

[63] Continuation of Ser. No. 823,181, Jan. 21, 1992, abandoned.

[30] Foreign Application Priority Data

Jan. 23, 1991 [JP] Japan ..... 3-006068

[51] Int. Cl.[6] ..... G03G 21/00; G03G 15/20

[52] U.S. Cl. ..... 355/319; 271/900; 355/282; 355/312; 355/315

[58] Field of Search ..... 355/319, 312, 355/315, 318, 282, 290, 308, 309; 219/216, 469–471; 271/309, 195, 312, 900

[56] References Cited

U.S. PATENT DOCUMENTS

| | | | |
|---|---|---|---|
| 3,502,407 | 3/1970 | Granzow et al. | 355/312 X |
| 3,826,568 | 7/1974 | Hudson | 355/315 |
| 3,827,855 | 8/1974 | Blake | 355/312 X |
| 3,955,813 | 5/1976 | Edwards | 271/309 |
| 4,286,863 | 4/1981 | Cornwall et al. | 355/312 X |
| 4,493,548 | 1/1985 | Ateya | 355/312 |
| 4,959,693 | 9/1990 | Mitsuya et al. | 355/319 X |
| 5,030,987 | 7/1991 | Kato et al. | 355/318 X |

FOREIGN PATENT DOCUMENTS

| | | | |
|---|---|---|---|
| 55-111975 | 8/1980 | Japan | 355/315 |
| 57-8974 | 6/1982 | Japan | 355/315 |
| 57-150860 | 7/1982 | Japan | 355/319 |
| 61-62087 | 3/1986 | Japan | 355/312 |
| 3-81791 | 4/1991 | Japan | 355/315 |
| 5-241470 | 9/1993 | Japan | 355/315 |

*Primary Examiner*—A. T. Grimley
*Assistant Examiner*—Shuk Y. Lee
*Attorney, Agent, or Firm*—Kenyon & Kenyon

[57] ABSTRACT

A development process and a fixing process are carried out on a front side of a recording paper. The paper recorded on the first side is transported toward a returning transportation device. The development process and the fixing process are then carried out on a back side of the paper. A nozzle for blowing out an air flow, an inverter roll for inverting the paper and the returning transportation device are arranged between the fixing station and a reversal station. The paper is deformed by the local cooling due to the air for peeling by the nozzle, the inverter roll and the returning transportation device. The portions (working regions) which receive the local cooling are arranged such that at most two of the working regions occur at any point of the recording medium paper. The inferiority of the local images in the defects in transfer and the local lowering degree in the density of the images are decreased.

14 Claims, 4 Drawing Sheets

RECORDING APPARATUS FOR PRINTING BOTH FACES OF A RECORDING MEDIUM USING AN ELECTROPHOTOGRAPHYPROCESS

This application is a continuation of application Ser. No. 07/823,181 filed Jan. 21, 1992, now abandoned.

BACKGROUND OF THE INVENTION

The present invention relates to a recording apparatus using an electrophotography process, more particularly to a recording apparatus for recording both faces of a recording medium using an electrophotography process.

The present invention relates to a recording apparatus for recording a first face and a second face of a recording medium of a recording paper in which the local uneven deformation in the recording medium due to the local cooling or the local defect in transfer due to the above local uneven deformation in the recording medium can be improved.

The present invention relates to a recording apparatus for recording a first face and a second face of a recording medium of a recording paper in which the local inferiority on the image toners or the local lowering in the density of the image toners can be improved.

A technique of a recording apparatus for recording both faces of the recording paper is proposed, for example in U.S. Pat. No. 4,959,693. This conventional, recording apparatus for recording both faces of the paper comprises a development station for forming non-fixed toner images on the paper (recording medium), a fixing station for heating, fusing and adhering the formed non-fixed toner images on the paper, a reversal station for reversing the paper, and a transportation means for transporting the paper from one station to another next station.

In the first place, after a first face such as a front side of the paper is developed in the development station, the paper is transported toward the fixing station and the paper is fixed in this fixing station. Next, the paper is transported toward the development station, during this paper transportation process the paper goes toward the development station by way of the reversal station in which the paper is reversed in this reversal station.

Next, with the condition in which the paper has been reversed, the development process for a second face such as a back side of the paper is carried out and the paper is fixed in the fixing station similar to the fixing for the first face of the paper and after the fixed paper is discharged from the recording apparatus. As a result, the recording for both faces of the paper is carried out in the conventional recording apparatus.

In the above conventional recording apparatus for recording both faces of the paper, the development station comprises a photosensitive member, a development unit and a transfer unit, and the toner images are formed using an electrophotography process.

In the above transportation means, the conveyor and the pinch rollers etc. are employed as a transportation element. The temperature in the transportation element is lowered less than the temperature in the paper after the first face of the paper has been fixed, and it further works a role of the function for cooling the paper after the first face of the paper has been through the fixing process.

As a heating means used in the fixing station, there are a heat roll fixing method, an oven fixing method and a flash fixing method etc..

In the heat roll fixing method, a fusion sandwiched portion is formed by a heat roll and a backup roll, and the fixing process is carried out on the fusion sandwiched portion by passing through the paper having the non-fixed toner images. In this heat roll fixing method, a paper peeling means is used to peel the paper from the heat roll. As this paper peeling means, there are a claw paper peeling method, an air peeling method for peeling the paper according to the blowing out air etc..

In the paper peeling process, the temperature of the paper peeling element for acting directly on the paper, namely the air and the claw, is lowered less than the temperature in the paper which has been through the fixing process. Also, the temperature of the paper peeling element has the function for cooling the paper.

In the air peeling method, a range for cooling the paper is a range in which the air flows on the face of the paper, generally the range is a portion on the face of the paper. In the conventional air peeling method, as disclosed in U.S. Pat. No. 3,955,813, this conventional recording apparatus has only one nozzle opening of blowing out air.

Further, the air blowing-out direction in the conventional recording apparatus is parallel with the peripheral direction of the heat roll and the air blowing-out direction is the substantially vertical direction with respect to the fusion sandwiched portion of the paper.

Further, the air blowing-out finish timing in the conventional recording apparatus is set at one of the following timings. One above timing is set that at the same time or after a tip portion of the paper is sandwiched by a next transportation means such as a pair of pinch rolls being adjacent to the heat roll. Another above timing is set that at the same time or after the tip portion of the paper is supported by the next transportation means such as a conveyor being adjacent to the heat roll.

Each of the transportation element or the paper peeling element acts on only the portion of the face of the paper. In the present invention, the range in which each of the transportation element or the paper peeling element acts on the face of the paper is called as a "working region" in the present invention.

In the case of the transportation element or the paper peeling claw, the above working region is a range in which the transportation element or the paper peeling claw contacts to the paper. In the case of the air peeling method, the working region is a range in which the air flows on the face of the paper.

Further, when a component necessary for using the air peeling method contacts to the face of the paper, such a contacting region is called the "working region" in the present invention. The above stated many working regions exist on the portions at any one point of the paper.

Besides, since the individual working region exists on the portion of the face of the paper, after the first face of the paper has been through the fixing process, the paper cooling area through the transportation element or the paper peeling element exists locally. However, since the paper cooling portion or region depends on the distribution of the working region, the local paper cooling portion is not limited one portion of the paper, but generally exists on many portions of the paper. This local paper cooling causes the local uneven deformation on the paper.

When after the fixing process for the first face of the paper has been carried out, the paper is transported toward the development station for fixing the second face of the paper leaving the paper having the local uneven deformation, the damage portion in the adhesion characteristic between the paper and the photosensitive member exists locally, and it may cause the defects in transfer on the above damage portion.

In the above stated conventional technique, no considerations are made to the local uneven deformation in the paper caused by the local cooling for the paper due to the transportation element and the peeling element and further the local defects in transfer caused by the above local uneven deformation in the paper. Accordingly, there are problems that the toners suffer local loss or the density in the toners become lower locally.

Further, during the starting time in which the temperature of the transportation element or the peeling element maintains lower, since the cooling degree for the paper is large, the difference in height of the uneven deformation of the paper becomes large, the local defects in transfer occur easily. In particular, during the starting time in the recording apparatus for recording both faces of the paper, there are problems that the degree of the local images defects and the degree of the local density lowering become large, respectively.

In particular, when the first face of the paper has been through the fixing process, many working regions which have been subjected to the cooling exist due to the transportation element, the peeling element and the air for peeling. After the fixing process for the first face of the paper has been carried out, when the second face of the paper is carried through the fixing process, many local defects occur in transfer at many working regions or at many subjected cooling portions on the paper.

In the conventional recording apparatus, a long time for recording both faces of the recording medium and the fixing process for the second face of the recording medium is carried out under the condition in which many working regions in the recording medium remain as they are.

When there is one working region which exists on the recording medium, the operator can hardly notice the defects in transfer on the recording medium. When there are two working regions which exist on the recording medium, the operator can notice dim white portions on the recording medium. These dim white come-out portions show the defects in transfer of the recording medium and all of the toners do not adhere to these dim white come-out portions.

Besides, when there are three working regions which exist on the recording medium, the operator can notice complete white come-out portions on the recording medium. These complete white come-out portions shown the defects in transfer of the recording medium and the toners do not adhere entirely to these complete white come-out portions.

Recently, in the recording apparatus only a short time is required for recording both faces of the recording medium. When the second face of the recording medium is carried through the fixing process, in the conventional recording apparatus it is necessary to carry out such a fixing process under the condition that many working regions remain as they are.

SUMMARY OF THE INVENTION

Figure 1:
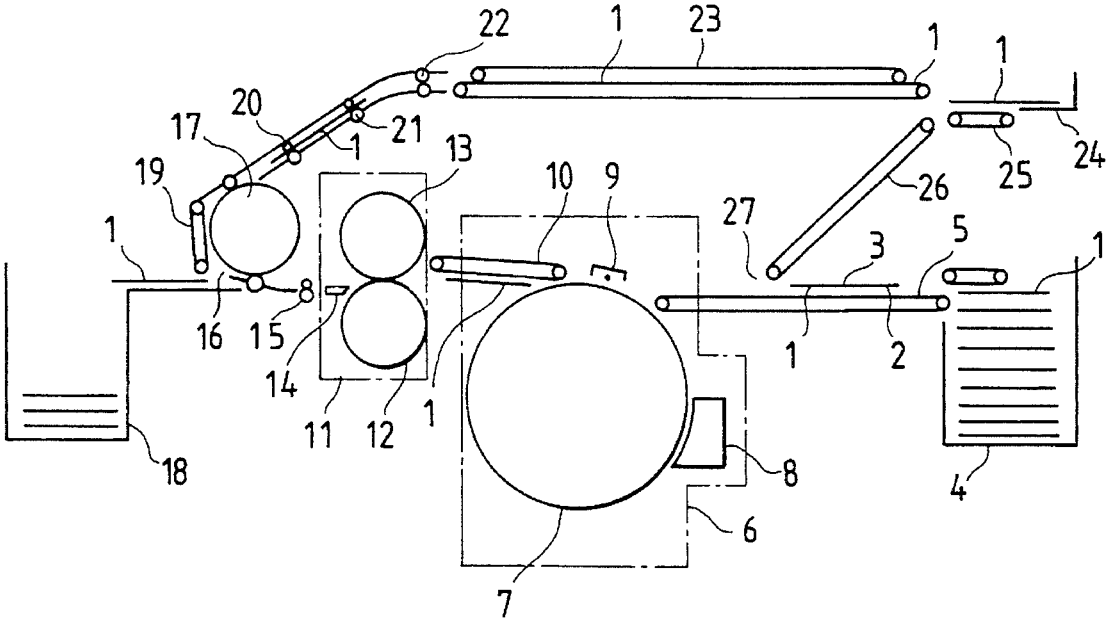
FIG. 1 is a schematic view showing one embodiment of a recording apparatus for recording both faces of a recording medium according to the present invention.

An object of the present invention is to provide a recording apparatus for recording a first face and a second face of a recording medium using an electrophotography process wherein the local inferiority in the images can be eliminated.

Another object of the present invention is to provide a recording apparatus for recording a first face and a second face of a recording medium wherein the lowering degree in the local density can be lessened.

A further object of the present invention is to provide a recording apparatus for recording a first face and a second face of a recording medium wherein during the starting of the recording apparatus the local inferiority in the images can be eliminated.

A further object of the present invention is to provide a recording apparatus for recording a first face and a second face of a recording medium wherein during the starting of the recording apparatus the lowering degree in the local density can be lessened.

A further object of the present invention is to provide a recording apparatus for recording a first face and a second face of a recording medium wherein the difference in height by the uneven deformation of the recording medium can be made smaller.

A further object of the present invention is to provide a recording apparatus for recording a first face and a second face of a recording medium wherein the adhesion characteristic of the recording medium to the photosensitive member at the fixing station can be increased.

In accordance with the present invention, a recording apparatus for recording a first face and a second face of a recording medium using an electrophotography process comprises a development station, a fixing station, a reversal station, a transportation means, a transportation element arranged on the midpoint of a section between the fixing station and the reversal station, and a peeling element arranged on the midpoint of the section between the fixing station and the reversal station, in which after the first face of the recording medium has been carried through the fixing process the second face of the recording medium is carried through the development process.

The working region which is occurred by the transportation element and the peeling element exists one at most at any one point on the recording medium. The working region exists one or the working region does not exist. The working region which is occurred between the air for peeling and the inverter roll and the returning transportation means exists two at most at any one point on the recording medium. The working region exists one at most at any one point on the recording medium.

Only at the period from the starting of the recording apparatus to the printing finish of a predetermined number of sheets for the recording medium, after the first face of the recording medium has been carried through the fixing process, the time for reaching to the development station for developing the second face of the recording medium is maintained longer. The time for staying the recording medium at the reversal station is maintained longer.

The air flow is blown out obliquely to both outsides from the central portion of the axial direction of the heat roll against the fusion sandwiched portion which is formed by the heat roll and the backup roll. At least two nozzle openings for blowing out the air flow are provided on the recording apparatus. The air flow is branched at the interior portion of the peeling means.

The blow-out finish timing of the air flow is selected at the case in which before the recording medium is sandwiched by the next transportation element adjacent to the heat roll or the case in which before the recording medium is supported by the next transportation element adjacent to the heat roll.

The transportation element or the peeling element is heated in the recording apparatus. The fixing station comprises the heat roll and the peeling means using the air for peeling, and the air for peeling is pre-heated by the remaining heat of the heat roll.

The temperature of the recording medium in which the first face of the recording medium has been carried through the fixing process is detected in at least one portion of the recording apparatus. The temperature of the transportation element is detected in at least one portion of the recording apparatus or the temperature of the peeling element is detected in at least one portion of the recording apparatus.

The detected temperature of the recording medium is collated with the detected temperature of the transportation element or with the detected temperature of the peeling element, and when the deviation of the difference in temperature is higher than the threshold value the recording medium is regarded as being defective in transfer and the printing process is carried out again in the recording apparatus.

The working region which occurs due to the peeling air and the inverter roll and the returning transportation means is formed two at most on the recording medium, and the air flow is blown out obliquely to both outsides from the central portion of the axial direction of the heat roll against the fusion sandwiched portion which is formed by the heat roll and the backup roll. The heat roll is changed over to a side of the high temperature mode or a side of the low temperature mode.

According to the present invention, since the difference in height by the uneven deformation of the recording medium due to the working region is made smaller and the adhesion characteristic of the recording medium to the photosensitive member at the fixing station is increased, the local inferiority in the images can be eliminated and the lowering degree in the local density can be lessened.

Since at the period from the starting of the recording apparatus to the printing finish of a predetermined number of sheets for the recording medium, after the first face of the recording medium is carried through the fixing process, the time for reaching to the development station for developing the second face of the recording medium is set longer, during the starting of the recording apparatus the local inferiority in the images can be go rid and the lowering degree in the local density can be lessened.

Since the local cooling of the recording medium due to the stagnate of the air for peeling is restrained, the local inferiority in the images can be eliminated and the lowering degree in the local density can be lessened.

To to attain the above stated various object of the present invention, the individual construction in the present invention will be explained in more detail as follows.

The working region, which occurs due to the peeling element, the inverter roll or the transportation element of the recording medium, is formed not to overlap on the recording medium as much as possible.

Only in a period between the starting in the recording apparatus for recording both faces of the recording medium and the finish in the printing press for a predetermined number of sheets of the recording medium, after the first face of the recording medium is carried out the fixing process, the time for reaching to the developement process for the second face of the recording medium is set longer. Further, the stay time in the reversal station of the recording medium is set longer.

When the air flow is used as the peeling means, the air flow is made to blow out obliquely to the fusion sandwiched portion formed by the heat roll and the backup roll toward both outsides from the central portion of the axial direction of the heat roll. The nozzle openings for blowing out the airflow in the peeling means are formed to have at least two. The air flow is formed to branch in the interior portion of the peeling means.

The blow-out finish timing of the air flow is set at the time in which before the tip portion of the recording medium is sandwiched by the next transportation means such as a pair of pinch rolls adjacent to the heat roll or before the time in which the tip portion of the recording medium is supported by the next transportation means adjacent to the heat roll.

The transportation element or the peeling element is heated according to the heating member. The air for peeling is pre-heated by the remaining heat in the heat roll.

The temperature of the recording medium is collated with the temperature of at least one portion in the transportation element or with the temperature of at least one portion in the peeling element. When the deviation between both temperatures is larger than the threshold value, such a recording medium is regarded as the recording medium having the defect in transfer and the recording medium is again carried through the printing process.

The working region on the recording medium occurred by the air for peeling, the heat roll and the returning transportation means is made formed fewer than two and also the air flow of the peeling means is made to blow out obliquely to the fusion sandwiched portion formed by the heat roll and the backup roll toward both outsides from the central portion of the axial direction of the heat roll.

The heat roll in the fixing station is enabled to change over to the low temperature mode side or to the high temperature mode side.

Next, the individual operation in the present invention will be explained in more detail as follows.

Since the number of the working region occurred due to the peeling element, the inverter roll or the transportation element of the recording medium is reduced. The difference in height of the uneven deformation of the recording medium can be reduced.

As a result, the adhesion characteristic between the recording medium and the photosensitive member in the development process on the second face of the recording medium after the fixing process finish of the first face of the recording medium can be increased and the defects in transfer in the recording medium can be reduced.

The difference in height of the uneven deformation occurring in the recording medium is decreased in proportion to the lapse of time. Accordingly, only in a period between the starting in the recording apparatus for recording both faces of the recording medium and the finish in the printing process for a predetermined number of sheets of the recording medium, after the first face of the recording medium is carried through the fixing process, the time is set longer, this time is one for reaching to the development process for the second face of the recording medium.

The reasons why during the starting in the recording apparatus since the temperature in the transportation element and the peeling element, the recording medium is passed through and is heated and the difference in temperature between the recording medium and the transportation element and the peeling element can be reduced. Accordingly, the working region of the recording medium can be cooled intensely during the starting in the recording apparatus.

Further, since the stay time in the reversal station of the recording medium is set longer, the difference in height of the uneven deformation in the recording medium can be reduced. As a result, the adhesion characteristic between the recording medium and the photosensitive member in the development process on the second face of the recording medium after the fixing process finish of the first face of the recording medium can be increased and the defects in transfer can be reduced.

In the case of the air flow used as the peeling means as shown in the conventional recording apparatus, the air is blown out vertically against the recording medium existing at the fusion sandwiched portion which is formed by the heat roll and the backup roll, thereby after the tip portion of the recording medium is separated from the surface of the heat roll the blow-out air having the lower temperature stagnates and stays in the space which is formed between the recording medium and the heat roll. As a result, the local cooling occurs in the recording medium.

However, according to the present invention, since the air flow is made to blow out obliquely toward both outsides from the central portion of the axial direction of the heat roll, after the tip portion of the recording medium is separated from the surface of the heat roll the air can pass through easily along to the fusion sandwiched portion. Accordingly, the air stay amount can be reduced fewer and the local cooling which occurs in the working region in the recording medium can be restrained.

Since the plural of the nozzle openings for blowing out the air are formed and as a result the air flow amount per one nozzle opening can be reduced, the air stay amount can be reduced.

Since the blow-out finish timing of the air flow is set at the time in which before the tip portion of the recording medium is sandwiched by the next transportation means adjacent to the heat roll or before the time in which the tip portion of the recording medium is supported by the next transportation means adjacent to the heat roll, under this short blow-out time of air the recording medium can be separated easily from the heat roll.

Accordingly, since the air blow-out time can be made short, the air blow-out amount can be reduced and as a result the air stay amount can be reduced. Thus, the local cooling which occurs in the working region in the recording medium can be restrained.

Since the transportation element or the peeling element is heated according to the heating member, it is possible to reduce the local cooling portion in the recording medium. Further, since the air for peeling is pre-heated by the remaining heat in the heat roll, the local cooling portion in the recording medium can be reduced fewer.

Since the temperature of the recording medium is collated with the temperature of at least one portion in the transportation element or the temperature of at least one portion in the peeling element and when the deviation between both temperatures is greater than the threshold value, such a recording medium is regarded as the recording having the defect in transfer and the recording medium is carried out again in advance the printing process, it can estimate the possibility of the defect in transfer and such a defect in transfer can be prevented.

Since the working region on the recording medium occurred by the air for peeling at the heat roll and the returning transportation means is made fewer than two and the air flow of the peeling means is made to blow out obliquely to the fusion sandwiched portion formed by the heat roll and the backup roll toward both outsides from the central portion of the axial direction of the heat roll, the local cooling portion in the recording medium can be reduced moreover and the difference in height of the uneven deformation of the recording medium due to this local cooling portion can be made smaller extremely and the adhesion characteristic between the recording medium and the photosensitive member can be improved effectively.

DETAILED DESCRIPTION:

One embodiment of a recording apparatus using an electrophotography process according to the present invention will be explained referring to the drawings.

FIG. 1 is a schematic view showing one embodiment of a recording apparatus for recording both faces of a recording medium using an electrophotography process according to the present invention.

In the recording apparatus for recording both faces of the recording medium shown in FIG. 1, the recording apparatus comprises a recording medium feeding hopper 4 for laminating a recording medium 1 such as a recording paper and for supplying the recording medium 1, a forwarding transportation means 5 for forwarding the recording medium 1, a development station 6 for developing the recording medium 1, a transportation means 10 for transportating the developed recording medium 1, and a fixing station 11 for fixing the developed recording medium 1.

The recording apparatus comprises further a nozzle 14 for blowing-out an air flow, the nozzle 14 is a peeling element of a peeling means for the fixed recording medium 1, a pair of pinch rolls 15 for pinching the recording medium 1 and arranged just behind the nozzle 14, a separation claw 16 for separating the recording medium 1, an inverter roll 17 for inverting the recording medium 1, and a recording medium discharging stack means 18 for accumulating the recording medium 1 in which a first face 2 and a second face 3 of the recording medium 1 has been recorded.

The recording apparatus comprises further a guide means 19 for guiding the recording medium 1 in which the first face 2 such as a front side of the recording medium 1 has been carried out the fixing process, a pair of pinch rolls 20 for pinching the recording medium 1, a pair of pinch rolls 21 for pinching the recording medium 1, a pair of pinch rolls 22 for pinching the recording medium 1, and a returning transportation means 23 for returning the recording medium 1 in which the first face 2 of the recording medium 1 has been carried through the fixing process.

The recording apparatus comprises further a reversal recording medium stack means 24 for reversing the recording medium 1 for developing the second face 3 such as a back side of the recording medium 1 in which the first face 2 of the recording medium 1 on which the fixing process has been carried out, a transportation means 25 for transporting the recording medium 1 and arranged at the reversal recording medium stack means 24 for reversing the recording medium 1, a returning transportation means 26 for returning the recording medium 1, and a joining portion 27 of the forwarding transportation means 5 and the returning transportation means 26.

The recording apparatus for recording both faces 2 and 3 of the recording medium 1 in the present invention, using an electrophotography process, first performs the development and the fixing for the first face 2 of the recording medium 1 and then performs the development process and the fixing process on the second face 3 of the recording medium 1. Accordingly, using this recording apparatus the recording medium 1 having the recording both on faces 2 and 3 can be formed in this embodiment according to the present invention.

A photosensitive member 7, a development unit 8 and a transfer unit 9 are arranged in the development station 6, respectively. The fixing station 11 comprises a heat roll 12 and a backup roll 13. The heat roll 12 installs a heat generating member (not shown) such as a halogen lamp etc.. In this embodiment of the present invention, as the fixing method in the fixing station 11, it employs a heat roll method having the heat roll 12 and the backup roll 13.

Figure 2:
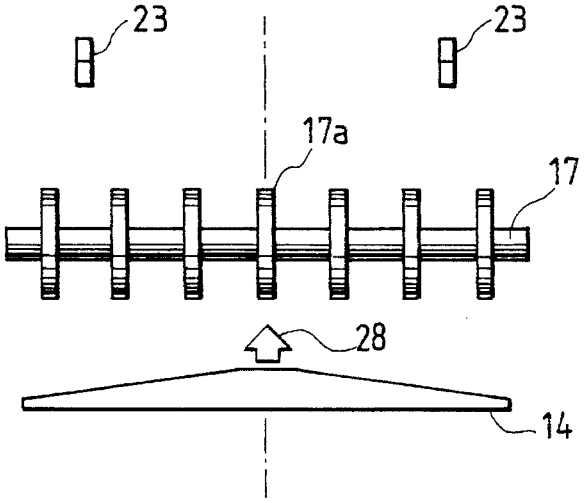
FIG. 2 is a developed explanatory view showing one embodiment of an arrangement relationship between air for peeling, an inverter roll and a returning transportation means toward a transportation direction of the recording medium of the recording apparatus for recording both faces of the recording medium according to the present invention.

Using the nozzle 14 for blowing out the air flow, as shown in FIG. 2, it can blow out an air flow 28 for peeling to the recording medium 1 toward a fusion sandwiched portion 29 which is formed by the heat roll 12 and the backup roll 13 of the fixing station 11. In other words, it employs an air peeling method for peeling the recording medium 1 in this embodiment of the present invention. The air flow 28 for peeling is blown out from a central portion of the nozzle 14 and further the peeled recording medium 1 is constructed so as not to contact the nozzle 14.

The recording medium separation claw 16 is changed over from one mode to another mode. One mode is a mode that the recording medium 1 in which the first face 2 of the recording medium 1 has been carried through the fixing process is returned by cooperating with the inverter roll 17 and the guide means 19 and the recording medium 1 is transported toward the returning transportation means 23, as shown in FIG. 1.

Another mode is that the recording medium 1 in which the first face 2 of the recording medium 1 has been carried through the fixing process is transported toward the recording medium discharging stack means 18. In the returning transportation means 23, it employs a transportation method for sandwiching and transporting the recording medium 1 using a pair of belts in this embodiment of the present invention.

In the embodiment shown in FIG. 1, the recording medium 1 accommodated in the recording medium feeding hopper 4 is arranged on the forwarding transportation means 5 and this recording medium 1 is transported toward the development station 6 comprising at least the photosensitive member 7, the development unit 8 and the transfer unit 9. At this development station 6, the toner images having the non-fixing state are formed on the first face 2 of the recording medium 1.

Next, the recording medium 1 to which the non-fixed toner images are adhered is transported toward the fixing station 11 and the recording medium 1 is heated at the fixing station 11, thereby the toner images of the first face 2 of the recording medium 1 are carried through the fixing process and the toner images adhere to the recording medium 1.

After the first face 2 of the recording medium 1 has been carried through the development process and the fixing process, the recording medium 1 passes through at an upper portion of the nozzle 14 for blowing out the air flow of the air 28 for peeling and reaches to the separating flow portion comprising the claw 16 for separation flow through the pair of pinch rolls 15.

When the printing mode for the second face 3 of the recording medium 1 is set, the recording medium 1 is carried out to make the separation flow at the upper portion at the separation flow portion and the recording medium 1 is transported toward the side of the inverter roll 17. The recording medium separation claw 16 for the separation flow carries out the separation flow by changing over the position of the separation claw 16 for the separation flow at the upper and lower sides.

At the condition shown in FIG. 1, the position of the recording medium separation claw 16 for the separation flow indicates the lower side, in this case the separation claw 16 for the separation flow carries out the separation flow motion toward the side of the inverter roll 17. When the separation claw 16 for the separation flow is positioned at the upper side, the separation claw 16 for the separation flow carries out the separation flow motion toward the side of the recording medium discharging stack means 18.

Next, the recording medium 1 is transported toward the returning transportation means 23 by the inverter roll 17 through the pairs of pinch rolls 20, 21 and 22. This recording medium 1 is stored once in the reversal recording medium stack means 24 and before the next recording medium 1 reaches the reversal recording medium stack means 24 this recording medium 1 is discharged toward the transportation means 26 through the transportation means 25 and reaches the joining flow portion 27.

The recording medium 1 passed through the joining flow portion 27 is transported toward the forwarding transportation means 5 and this recording medium 1 reaches again to the development station 6. In this time, the first face 2 of the recording medium 1 having been printed is made to face toward the upper side. Accordingly, at the development station 6, the non-fixed toner images are formed on the second face 3 of the recording medium 1.

Next, similar to the fixing process with the first face 2 of the recording medium 1, the second face 3 of the recording medium 1 is carried through the fixing process. In this time, the separation claw 16 for the separation flow is changed over toward the upper position and both the first face 2 and the second face 3 of the recording medium 1 have been carried through the printing process and the recording medium 1 is discharged to the recording medium stack means 18.

As stated above, the motion and the constitution of the recording apparatus for recording both faces 2 and 3 of the recording medium 1 in this embodiment according to the present invention are explained by paying attention to the movement of a sheet of the recording medium 1 such as a recording paper. However, as a practical matter, this motion is carried out continuously at every recording medium 1.

The inventors of the present invention have found that the air 28 for peeling, the inverter roll 17 and the returning transportation means 23 give the affects with respect to the defect in transfer and when the working region of the above stated elements overlaps, the inferiority in images occurs at that overlapped portion.

When the working region due to the air 28 for peeling, the inverter roll 17 and the returning transportation means 23 overlaps, the cooling operation is kept up the overlapped portion and accordingly the overlapped portion is deformed unevenly.

FIG. 2 is a developed explanatory view showing one embodiment of the positional relationship between the air for peeling, the inverter roll and the returning transportation means with respect to the transportation direction of the recording medium of the recording apparatus for recording both faces of the recording medium according to the present invention.

In FIG. 2, the transportation direction of the recording medium 1 coincides with the upper and lower direction in the drawing. In the embodiment of the present invention shown in FIG. 2, the working region due to the air 28 for peeling and the working region due to a portion 17*a* of the inverter roll 17 overlap, however the working region due to the air 28 for peeling and the working region due to the inverter roll 17 excluding the portion 17*a* do not overlap.

Further, the working region due to the air 28 for peeling and the working region due to the returning transportation means 23 do not overlap, and also the working region due to the inverter roll 17 and the working region due to the returning transportation means 23 do not overlap.

In FIG. 2, all of three working regions which comprises the working region due to the air 28 for peeling, the working region due to the inverter roll 17 and the returning transportation means 23 do not overlap. Namely, an overlap does not occur the at the working region of the above three elements.

Accordingly, in the embodiment of the present invention shown in FIG. 2, by overlapping the working region it is possible to reduce the difference in height of the uneven deformation which occurs in accordance with the maintenance of the local cooling.

Therefore, it is possible to increase the adhesion characteristic to the photosensitive member 7 during the development process for the second face 3 of the recording medium 1 to obtain the effect in which the images having less inferior local images can be formed.

Figure 3:
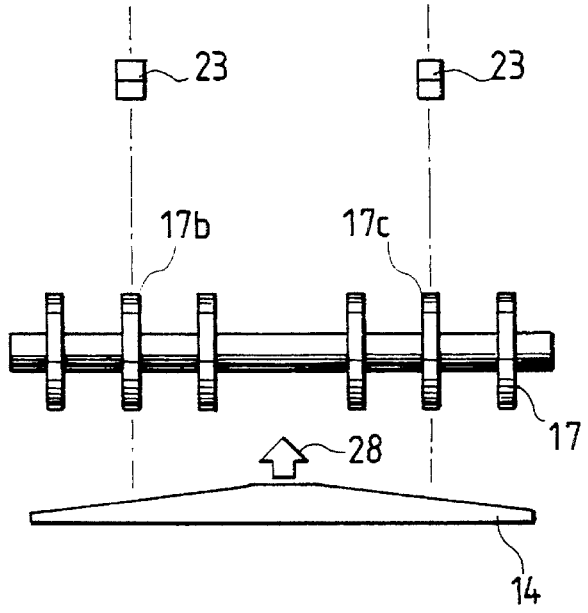
FIG. 3 is a developed explanatory view showing another embodiment of an arrangement relationship between air for peeling, an inverter roll and a returning transportation means toward a transportation direction of the recording medium of the recording apparatus for recording both faces of the recording medium according to the present invention.

FIG. 3 is a developed explanatory view showing another embodiment of the positional relationship between the air for peeling, the inverter roll and the returning transportation means with respect to the transportation direction of the recording medium of the recording apparatus for recording both faces of the recording medium according to the present invention.

In the embodiment of FIG. 3, the working regions due to a portion 17*b* and a portion 17*c* of the inverter roll 17 and the working region due to the returning transportation means 23 overlap. However, the working region due to the air 28 for peeling and the working region due to the heat roll 17 do not overlap. Further, the working region due to the air 28 for peeling and the working region due to the returning transportation means 23 do not overlap.

In FIG. 3, all of three working regions which comprises the working region due to the air 28 for peeling, the working region due to the inverter roll 17 and the returning transportation means 23 do not overlap. Namely, there does not occur the overlap at the working region within all including the above three elements together with.

The inventors of the present invention that when the overlap between the working region of the air 28 for peeling and the working region of the inverter roll 17 and the working region of the returning transportation means 23 gets completely rid of within the same recording medium 1, accordingly it does not cause the lowering in density of the local images. The reasons are similar to the above reasons in which the working region in the above stated three elements overlap.

In the embodiment of the present invention shown in FIG. 3, the printing process is carried out with the same one in the case of the printing process shown in FIG. 1.

According to this embodiment of the present invention shown in FIG. 3, within the above stated three elements the working region of the inverter roll 17 and the working region of the returning transportation means 23 overlaps, however the working region of the inverter roll 17 and the working region of the returning transportation means 23 do not overlap with the working region of the air 28 for peeling. Accordingly, the effect can be obtained in which the inferiority in the local toner images and also the lowering in density of the local toner images do not occur.

In the embodiment of the present invention, the working region has been subjected or received the cooling due to the transportation element or the peeling element. The existence of one working region (one subjected cooling portion or one subjected cooling region) indicates that there is no overlap portion by the working regions. The existence of two working regions (two subjected cooling portions or two subjected cooling regions) indicates that there is one overlap portion by the working regions.

Many working regions (the subjected cooling portions) are occurred in the conventional recording apparatus, however the working region (the subjected cooling portion) is reduced and only at most two working regions overlap in the recording apparatus according to the embodiment of the present invention.

In the embodiment of the present invention, when the second face 3 of the recording medium 1 is carried through the fixing process, it is possible to carry out such a fixing process under the working regions having two at most, accordingly the recording for both faces of the recording medium 1 can be attained at the short time with the high speed transportation of the recording medium 1.

Further, it is possible to arrange not to overlap completely all working regions of the transportation elements and all working regions of the peeling elements from the rear side of the fixing station 11 to just before the reversal recording medium stack means 24.

Accordingly, in addition to no occurrence of the inferiority in the local images and the lowering in density of the local images it can obtained the effects in which the tolerances in the inferior in the local images and the lowering in density of the local images can be made larger fully.

The inventors of the present invention find out also the facts in which the badness in transfer is occurred in the recording medium 1 during the starting of the recording apparatus, for example at about 20 sheets of the recording medium 1 from the beginning, accordingly it causes the high occurrence degree of the badness in transfer.

The reasons are that during the starting of the recording apparatus the temperatures in the transportation element and the peeling element become lower and the difference in temperatures between the recording medium 1 and the transportation element and the peeling element.

As a result, in the present invention during the starting of the recording apparatus the recording medium 1 is made to pass through the transportation element and the peeling element. It lowers the difference in temperatures between the recording medium 1 and the transportation element and the peeling element.

Accordingly, the working region of the recording medium 1 is cooled intensely during the starting of the recording apparatus. Further, since the stay time for the recording medium 1 at the reversal station is longer, it is possible to reduce the difference in height of the recording medium 1.

In this embodiment of the present invention, the following control is carried out in the recording apparatus. Namely, from the starting of the recording apparatus for recording both faces 2 and 3 of the recording medium 1, when predetermined sheets of the recording medium 1, for example only about 20 sheets of the recording medium 1 from the beginning, have been carried out the printing process and the recording medium 1 reaches to the reversal recording medium stack means 24, the recording medium 1 is made to stop once in the reversal recording medium stack means 24.

When the next recording medium 1 may enter into the reversal recording medium stack means 24, the former recording medium 1 which has been stayed in the reversal recording medium stack means 24 is transported toward the joining flow portion 26.

As the above stated control is practised in the recording apparatus, during the star ting of the recording apparatus after the first face 2 of the recording medium 1 has been carried through the fixing process, the time for reaching the development station 6 of the second face 3 of the recording medium 1 is increased.

As a result, it can decrease the defect in transfer in the recording medium which occurs during the starting of the recording apparatus and the inferiority in the local images occurring during the starting and the lowering in density of the local images can be reduced.

Figure 4:
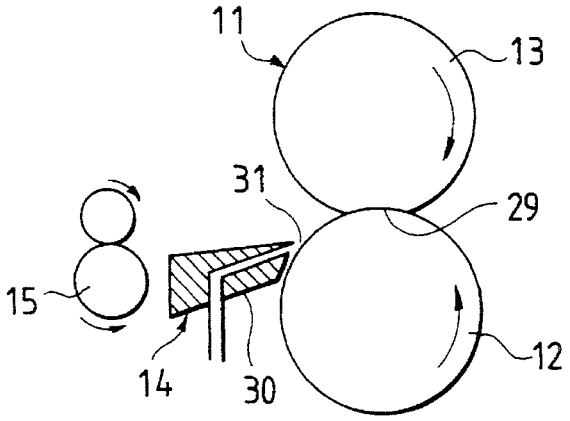
FIG. 4 is an enlarged longitudinal cross-sectional view showing one embodiment of a fixing station.

FIG. 4 is an enlarged cross-sectional view showing one embodiment of the fixing station according to the present invention. In the embodiment shown in FIG. 4, the nozzle 14 forms the air flow for peeling along the face which contacts a nozzle block 30. Two nozzle openings 31 are formed in the nozzle block 30 and the nozzle openings 31 open and face toward an end face of the side of the heat roll 12. Two nozzle openings 31 are provided on the nozzle block 30 as shown in FIGS. 5 and 6.

The air 28 for peeling from each of the nozzle openings 31 is blown out before the tip portion of the recording medium 1 is discharged from the fusion sandwiched portion 29. The recording medium 1 which has been discharged from the fusion sandwiched portion 29 is peeled from the heat roll 12 by blowing out the tip portion of the recording medium 1. The tip portion of the peeled recording medium 1 passes through the upper face side of the nozzle 14 and reaches to the pair of pinch rolls 15.

The necessary and sufficient condition for separating the recording medium 1 from the heat roll 12 is that the tip portion of the recording medium 1 must reach to the upper face side of the nozzle 14. Accordingly, in this embodiment of the present invention with the timing in which the tip portion of the recording medium 1 reaches the upper face side of the nozzle 14, the blow-out of the air 28 for peeling is finished.

Figure 5:
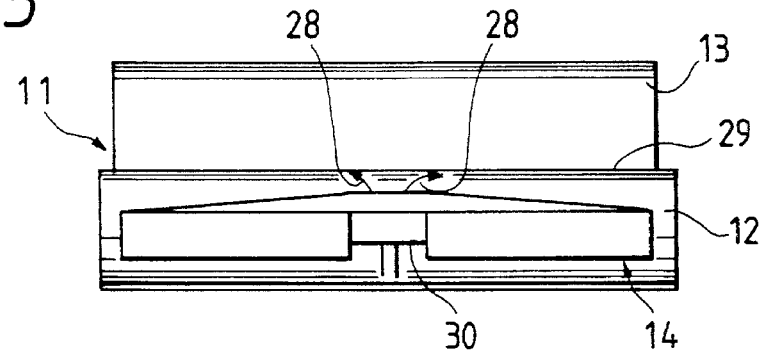
FIG. 5 is an enlarged plane view showing one embodiment of the fixing station in which a nozzle is seen taking from at a side of pair of pinch rolls.
Figure 6:
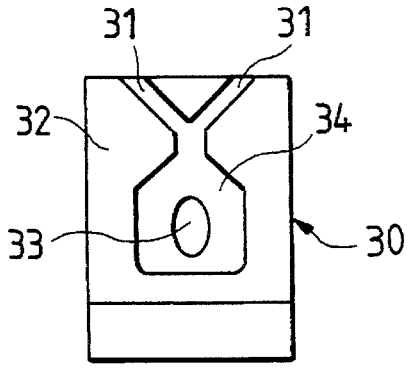
FIG. 6 is a plane view showing another embodiment of the nozzle for blowing out an air flow of air for peeling.

FIG. 5 is another embodiment of the fixing station according to the present invention and is an enlarged plane view showing the fixing station taken along the side of the pinch roll.

In the embodiment shown in FIG. 5, the air 28 for peeling is branched from the central portion of the axial direction of the heat roll 12 with respect to the fusion sandwiched portion 29 and the air 28 for peeling is blown out obliquely toward both sides.

According to the above stated construction, the blow-out air amount per one nozzle opening decreases and after the air 28 for peeling reaches the fusion sandwiched portion 29, the air flow is formed for going to the end portion of the heat roll 12 along the fusion sandwiched portion 29.

In the prior art, since the air for peeling is blown out from the central portion of the axial direction of the heat roll toward the vertical direction, there is no escape space for the blow-out air and as a result this blow-out air stagnates and stays, however in this embodiment according to the present invention the amount of the stayed blow-out air can be reduced.

Figure 7:
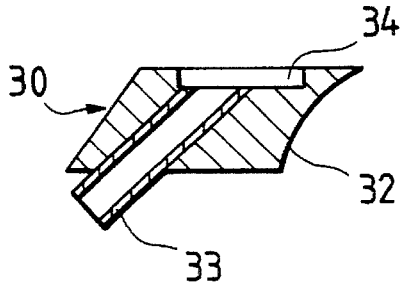
FIG. 7 is a longitudinal cross-sectional view showing the nozzle shown in FIG. 6.

FIG. 6 is an enlarged view showing one embodiment of the nozzle block and also is an enlarged view showing the nozzle block taken along the side of the contacting face between the nozzle and the nozzle block. FIG. 7 is an enlarged cross-sectional view showing the nozzle block.

In the nozzle block 32 construction shown in FIGS. 6 and 7, the nozzle block 32 is constituted of an air introducing pipe 33, a cut-off portion 34 and two nozzle openings 31. The cut-off portion 34 forms the flow passage by joining the nozzle block 32 with the nozzle 14 and the nozzle openings 31 branch with two portions from the flow passage.

A pipe (not shown) made by vinyl material is connected to the air introducing pipe 33 and this pipe is connected to a compressor through an electromagnetic valve. With this construction, the air flow amount per one nozzle opening becomes half (½). However, the air flow amount in the air introducing pipe 33 is the same as that of the conventional peeling means.

In this time, since there is no reduction in the whole air flow amount for peeling, therefore the peeling performance is not lowered. According to this embodiment of the present invention, since the nozzle openings 31 are formed in two portions in accordance with the separation flow from the air introducing pipe 33, the number of the electromagnetic valve and the compressor can be got over with only one.

Figure 8:
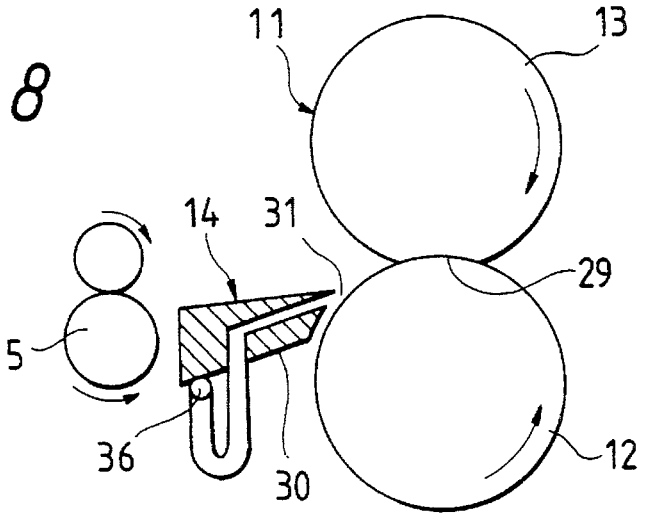
FIG. 8 is a longitudinal cross-sectional view showing another embodiment of the nozzle for blowing out an air flow of air for peeling.

FIG. 8 is a longitudinal cross-sectional view showing another embodiment of the nozzle for blowing out the air for peeling according to the present invention.

In the nozzle 14 construction of this embodiment shown in FIG. 8, a pre-heating means for heating the air 28 for peeling is added to the nozzle 14 construction shown in FIG. 4. This pre-heating means heats in advance the air by a heating means (not shown). The heated air is introduced into the nozzle block 30 through a pre-heating pipe 36 and the air 28 for peeling is blown out from the nozzle opening 31. The pre-heating pipe 36 is made of copper material. The nozzle block 30 is made of aluminum material having a high heat conductivity characteristic.

In this embodiment according to the present invention, the time for fully reaching the high temperature by the pre-heating of the air 28 for peeling coincides substantially with the time in which the heat roll 12 has risen from room temperature to the temperature at which the fixing process may be carried out.

As stated above, in this embodiment of the present invention, since the air 28 for peeling is pre-heated and is blown out to the recording medium 1 with the high temperature condition, the cooling in the working region of the air 28 for peeling can be restrained. Accordingly, the defect in transfer in the printing for the second face 3 of the recording medium 1 can be reduced.

Further, since the time necessary for increasing the temperature of the nozzle block 30 is substantially to the same as the time necessary for increasing the temperature of the heat roll 12, excellent printing can be carried out starting with the first sheet of the recording medium 1.

Figure 9:
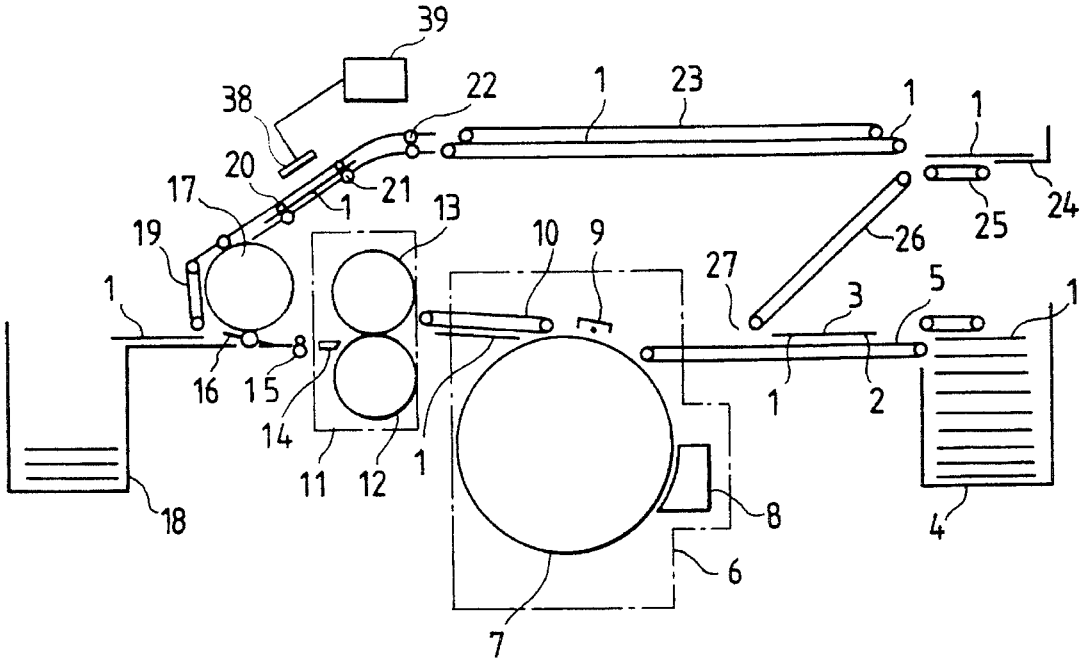
FIG. 9 is a schematic view showing another embodiment of a recording apparatus for recording both faces of a recording medium according to the present invention.

FIG. 9 is a schematic view showing another embodiment of a recording apparatus for recording both faces of a recording medium according to the present invention.

In the embodiment shown in FIG. 9, on all transportation elements after the fixing station 6 to the returning transportation means 23, a temperature detector (not shown) for detecting the temperature of the transportation elements themselves are provided and a detected transportation element temperature data is sent to a controlling unit 39.

Further, a recording medium temperature detector 38 is provided at a selected suitable position between the fixing station 6 and the returning transportation means 23 and a detected recording medium temperature data is sent to the controlling unit 39.

The controlling unit 39 collates the temperature data from the recording medium temperature detector 38 with a mean value of the temperature data about the transportation element which is sampled at substantially the same time. A deviation in difference is compared with a predetermined set threshold value.

When the deviation in difference becomes larger than the predetermined set threshold value, it determines defects in transfer in the recording medium 1 and then a transfer defect signal is generated. The predetermined set threshold value is set in accordance with the occurrence of the defects in transfer in the actual recording apparatus as the standard.

The defects transfer in the recording medium 1 occurs in accordance with the large difference in temperature between the temperature of the recording medium 1 in which the first face 2 of the recording medium 1 is carried through the fixing process and the temperature of the transportation element and the peeling element.

The controlling unit 39 detects the above large difference in temperature and such a recording medium 1 is regarded as the jam recording medium 1 in which the defect in transfer occurs and then the printing process for such a recording medium 1 is carried out again. Accordingly, it can prevent defects in transfer from occurring on the final or end printing images.

Figure 10:
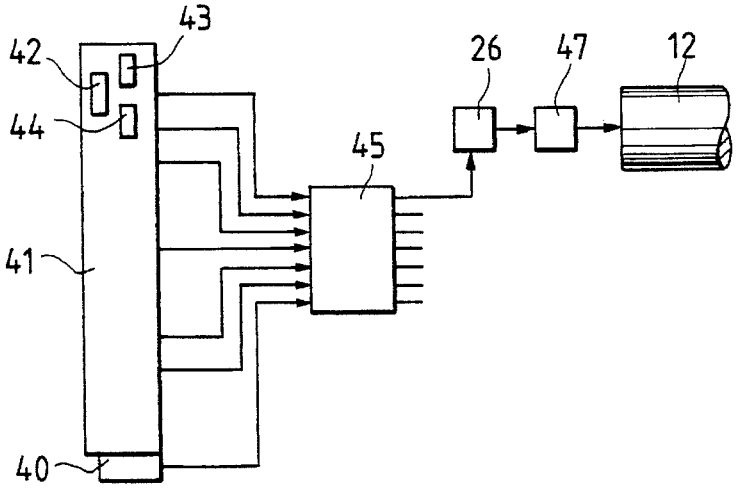
FIG. 10 is an electric control circuit having essential parts showing another embodiment of a recording apparatus for recording both faces of a recording medium according to the present invention.

FIG. 10 is a further embodiment of the recording apparatus for recording both faces of the recording medium according to the present invention and shows circuitry of the essential parts.

In the embodiment shown in FIG. 10, the circuitry comprises an electric power source switch 40, an operating board 41, a microcomputer 45, an electric current controller 47 for the heating member (not shown) of the heat roll 12, and an electric source means 46 for the heating member of the heat roll 12.

The operating board 41 comprises a mode change-over switch 42, a low temperature mode indicating member 43, and a high temperature mode indicating member 44. The microcomputer 45 inputs signals from each of the switches of the electric power source switch 40 and the operating board 41 and further the microcomputer 45 outputs the control signal to the electric power source means 46 for the heating member of the heat roll 12.

In the above embodiment of the present invention, when the operator wants to form the permanent keepable printing materials or the long-period keepable printing materials, the operator can operate to change over to the side of the high temperature mode by the mode change-over switch 42. This change-over signal for the high temperature mode is input into the microcomputer 45.

The microcomputer 45 outputs to the electric power source means 46 the control signal so as to supply the large electric current to the heating member of the heat roll 12 and then this large electric current is supplied to the heating member of the heat roll 12. Accordingly, the heating member of the heat roll 12 generates heat having the high temperature, thereby the non-fixed toner images are carried through the fixing process with the high temperature.

When the usual printing materials are carried through the printing process, the operator can operate to change over the side of the low temperature mode by the mode change-over the side of the low temperature mode by controlling the mode change-over switch 42. At the time it is changed over to the side of the low temperature mode, the microcomputer 45 outputs to the electric power source means 46 the control signal so as to supply the small electric current to the heating member of the heat roll 12 and then this small electric current is supplied to the heating member of the heat roll 12.

As a result, the heating member of the heat roll 12 generates heat having the low temperature, thereby the consumption amount in the electric power can be reduced.

Further, on the condition in which it is changed over to the high temperature mode, the set time elapses when the recording medium 1 is not supplied from the side of the recording medium feeding hopper 4, then the high temperature mode can be changed over automatically to the side of the low temperature mode.

As a result, leaving the electric power source switch 40 as on-condition, it is possible to use every time the recording apparatus for recording both faces of the recording medium 1 and also the consumption amount in the electric power can be reduced.

According to this embodiment of the present invention, the consumption amount in the electric power can be reduced.

We claim:

1. A recording apparatus for recording a first face and a second face of a recording medium using an electrophotography process comprising;

a development station for developing said recording medium;

a fixing station for fixing said developed recording medium;

a reversal station for reversing said recording medium;

a transportation means for transporting said recording medium;

a transportation element having a working region and arranged on a midpoint of a section of said fixing station and said reversal station; and a peeling element for separating said recording medium and having a working region and arranged on the midpoint of said section of said fixing station and said reversal station;

wherein after a fixing process has been carried out on said first face of said recording medium a developing process is carried out on said second face of said recording medium; and wherein said transportation element and said peeling element are arranged such that at most only one of the working region of said transportation element and the working region of said peeling element exists at any one point on said recording medium.

2. A recording apparatus for recording a first face and a second face of a recording medium using an electrophotography process comprising:

a development station for developing said recording medium;

a fixing station for fixing said developed recording medium;

a reversal station for reversing said recording medium;

a forwarding transportation means for forwarding said recording medium;

a returning transportation means for returning said recording medium and having a working region;

an inverter roll having a working region and arranged on a midpoint of a section of said fixing station and said reversal station; and an air for separating said recording medium and having a working region and arranged on the midpoint of said section of said fixing station and said reversal station;

wherein after a fixing process has been carried out on said first face of said recording medium a developing process is carried out on said second face of said recording medium; and wherein said air for separating said recording medium, said inverter roll and said returning transportation means are arranged such that at most two of the working region of said air for separating said recording medium, the working region of said inverter roll and the working region of said returning transportation means exist at any one point on said recording medium.

3. A recording apparatus for recording a first face and a second face of a recording medium according to claim 2, wherein at most one of the working region of said air for separating said recording medium, the working region of said invertor roll and the working region of said returning transportation means exist at any one point on said recording medium.

4. A recording apparatus for recording a first face and a second face of a recording medium according to claim 1, wherein only at a period from a starting of the recording apparatus to a printing finish of a predetermined number of sheets for said recording medium, after a fixing process has been carried out on said first face of said recording medium, a time for reaching said development station for developing said second face of said recording medium is maintained longer.

5. A recording apparatus for recording a first face and a second face of a recording medium according to claim 4, wherein a time for keeping said recording medium at said reversal station is maintained longer.

6. A recording apparatus for recording a first face and a second face of a recording medium using an electrophotography process comprising:

a development station for developing said recording medium;

a fixing station for fixing said developed recording medium;

a reversal station for reversing said recording medium; and a transportation means for transporting said recording medium;

said fixing station having a heat roll, a backup roll and a peeling element, the peeling element comprising an air flow for separating said recording medium from said heat roll according to the air flow, wherein the peeling element is provided only at a rolling-up direction of the recording medium from a side of the recording medium closest to the heat roll;

wherein after a fixing process has been carried out on said first face of said recording medium a developing process is carried out on said second face of said recording medium; and wherein the air flow is blown out obliquely along a plurality of boundary layers at first against a surface wall of said heat roll to both outside directions from a central portion in an axial direction and a peripheral direction of said heat roll against a fusion sandwiched portion which is formed by said heat roll and said backup roll.

7. A recording apparatus for recording a first face and a second face of a recording medium according to claim 6, wherein at least two nozzle openings for blowing out the air flow are provided on the recording apparatus.

8. A recording apparatus for recording a first face and a second face of a recording medium according to claim 6, wherein the air flow is branched at said peeling element.

9. A recording apparatus for recording a first face and a second face of a recording medium using an electrophotography process comprising:

a development station for developing said recording medium;

a fixing station for fixing said developed recording medium;

a reversal station for reversing said recording medium; and a transportation means for transporting said recording medium;

said fixing station having a heat roll, a backup roll and a peeling element comprising an air flow for separating said recording medium from said heat roll according to the air flow;

wherein after a fixing process has been carried out on said first face of said recording medium a developing process is carried out on said second face of said recording medium;

wherein the air flow is blown out obliquely to both outside directions from a central portion of an axial direction of said heat roll against a fusion sandwiched portion which is formed by said heat roll and said backup roll; and wherein a blow-out finish timing of the air flow is selected before said recording medium is sandwiched by a next transportation element adjacent to said heat roll and before said recording medium is supported by said next transportation element adjacent to said heat roll.

10. A recording apparatus for recording a first face and a second face of a recording medium according to claim 1, wherein at least one of said transportation means and said peeling element is heated in the recording apparatus.

11. A recording apparatus for recording a first face and a second face of a recording medium according to claim 10, wherein said fixing station comprises a heat roll and a peeling means using the peeling element, and the peeling element is pre-heated by a remaining heat of said heat roll.

12. A recording apparatus for recording a first face and a second face of a recording medium according to claim 1, wherein a temperature of said recording medium in which a fixing process has been carried out on said first face of said recording medium is detected in at least one portion of the recording apparatus, a temperature of said transportation means is detected in at least one portion of the recording apparatus, a temperature of said peeling element is detected in at least one portion of the recording apparatus, said detected temperature of said recording medium is collated with at least one of said detected temperatures of said transportation means and said peeling element, and when a deviation of the difference in temperature is greater than a threshold value said recording medium is regarded as having a defect in transfer and a printing process is again carried out in the recording apparatus.

13. A recording apparatus for recording a first face and a second face of a recording medium using an electrophotography process comprising:

a development station for developing said recording medium;

a fixing station for fixing said developed recording medium;

a reversal station for reversing said recording medium;

a forwarding transportation means for forwarding said recording medium;

a returning transportation means for returning said recording medium and having a working region; and an inverter roll having a working region and arranged on a midpoint of a section of said fixing station and said reversal station;

said fixing station having a heat roll, a backup roll and a peeling element having a working region and for separating said recording medium from said heat roll according to an air flow;

wherein after a fixing process has been carried out on said first face of said recording medium a developing process is carried out on said second face of said recording medium;

wherein said peeling element, said inverter roll and said returning transportation means are arranged such that at most two of the working region of said peeling element, the working region of said inverter roll and the working region of said returning transportation means are formed at any one point on said recording medium; and wherein the air flow is blown out obliquely to both outside directions from a central portion of an axial direction of said heat roll against a fusion sandwiched portion which is formed by said heat roll and said backup roll.

14. A recording apparatus for recording a first face and a second face of a recording medium according to claim 9, wherein said air flow blow-out finish timing provides an intermittent blow-out of the air flow, wherein said air flow blow-out timing is determined by a positional relation between said transportation means and said recording medium.

* * * * *

UNITED STATES PATENT AND TRADEMARK OFFICE

CERTIFICATE OF CORRECTION

PATENT NO. : 5,459,562

DATED : October 17, 1995

INVENTOR(S) : Teruaki MITSUYA et al.

It is certified that error appears in the above-identified patent and that said Letters Patent is hereby corrected as shown below:

| Column | Line | |
|---|---|---|
| 1 | 37 | Delete "next". |
| 2 | 32 | Delete "that". |
| 2 | 35 | Delete "that". |
| 2 | 43 | Delete "as". |
| 2 | 63 | After "limited" insert --only to--. |
| 3 | 35 | Before "long" insert --comparatively--; after "time" insert --is necessary--. |
| 3 | 51 | Change "shown" to --show--. |
| 4 | 15 | Change "taking" to --taken--. |
| 4 | 16 | Delete "at"; before "pair" insert --a--. |
| 5 | 10 | Change "The" to --At most one--; change "is occurred by" to --results from--. |

UNITED STATES PATENT AND TRADEMARK OFFICE

CERTIFICATE OF CORRECTION

PATENT NO. : 5,459,562

DATED : October 17, 1995

INVENTOR(S) : Teruaki MITSUYA et al.

It is certified that error appears in the above-identified patent and that said Letters Patent is hereby corrected as shown below:

| Column | Line | |
|---|---|---|
| 5 | 11 | Delete "one at most". |
| 5 | 13 | Delete "one"; change "The" to --At most two--. |
| 5 | 14 | Change "region" to --regions--; change "is occurred" to --occur--. |
| 5 | 15 | Change "exists" to --exist--. |
| 5 | 16 | Delete "two at most"; change "The" to --At most one--. |
| 5 | 17 | Delete "one at most". |
| 6 | 14 | After "reaching" delete "to". |
| 6 | 17 | Change "go rid" to --eliminated--. |

UNITED STATES PATENT AND TRADEMARK OFFICE

CERTIFICATE OF CORRECTION

PATENT NO. : 5,459,562

DATED : October 17, 1995

INVENTOR(S) : Teruaki MITSUYA et al.

It is certified that error appears in the above-identified patent and that said Letters Patent is hereby corrected as shown below:

| Column | Line | |
|---|---|---|
| 6 | 20 | Change "stagnate" to --stagnation--. |
| 6 | 23 | After "To" delete "to"; change "object" to --objects--. |
| 6 | 35 | Change "out" to --through--. |
| 6 | 36 | After "reaching" delete "to". |
| 7 | 1 | Delete "formed". |
| 7 | 11 | Change "occurred" to --occurring--. |
| 7 | 13 | After "reduced" change "." to --,--; change "The" to --the--. |
| 7 | 30 | After "reaching" delete "to". |

UNITED STATES PATENT AND TRADEMARK OFFICE

CERTIFICATE OF CORRECTION

PATENT NO. : 5,459,562

DATED : October 17, 1995

INVENTOR(S) : Teruaki MITSUYA et al.

It is certified that error appears in the above-identified patent and that said Letters Patent is hereby corrected as shown below:

| Column | Line | |
|---|---|---|
| 8 | 2 | Change "the plural" to --a plurality--. |
| 8 | 25 | After "reduced" delete "fewer". |
| 8 | 67 | Change "transportating" to --transporting-- |
| 9 | 16 | Change "out" to --through--. |
| 9 | 42 | Change "both on" to --on both--. |
| 11 | 22 | Change "give the affects" to --have an effect--. |
| 11 | 52 | Change "comprises" to --comprise--. |
| 11 | 56 | After "occur" delete "the". |
| 12 | 17 | Change "comprises" to --comprise--. |
| 12 | 22 | After "together" delete "with". |

UNITED STATES PATENT AND TRADEMARK OFFICE

CERTIFICATE OF CORRECTION

PATENT NO. : 5,459,562

DATED : October 17, 1995

INVENTOR(S) : Teruaki MITSUYA et al.

It is certified that error appears in the above-identified patent and that said Letters Patent is hereby corrected as shown below:

| Column | Line | |
|---|---|---|
| 12 | 23 | After "invention" insert --have found--. |
| 12 | 26 | Delete "gets". |
| 12 | 27 | Change "completely rid of" to --is completely eliminated--. |
| 12 | 56 | Change "are occurred" to --occur--. |
| 13 | 11 | Delete "find out also the" and insert --have also found that--. |
| 13 | 12 | Delete "facts in which the badness in transfer is occurred" and insert --the defects in transfer occur--. |
| 13 | 16 | Change "badness" to --defects--. |

UNITED STATES PATENT AND TRADEMARK OFFICE
CERTIFICATE OF CORRECTION

PATENT NO. : 5,459,562

DATED : October 17, 1995

INVENTOR(S) : Teruaki MITSUYA et al.

It is certified that error appears in the above-identified patent and that said Letters Patent is hereby corrected as shown below:

| Column | Line | |
|---|---|---|
| 13 | 40 | Change "out" to --through--. |
| 13 | 51 | Change "star ting" to --starting--. |
| 14 | 55 | Change "by" to --of--. |
| 14 | 62 | Change "In" to --At--. |
| 15 | 1 | Change "got over with" to --reduced to--. |
| 15 | 30 | After "substantially" delete "to". |
| 16 | 44 | Delete "the mode change-over". |
| 16 | 45 | Delete "the side of the low temperature mode by". |

Signed and Sealed this

Fourteenth Day of May, 1996

*Attest:*

Bruce Lehman

BRUCE LEHMAN

*Attesting Officer*

*Commissioner of Patents and Trademarks*